United States Patent [19]

Robinson

[11] Patent Number: 4,922,630

[45] Date of Patent: May 8, 1990

[54] ATHLETIC SHOE WITH INVERSION RESISTING DEVICE

[75] Inventor: John R. Robinson, Beaverton, Oreg.

[73] Assignee: Nike, Inc. and Nike International Ltd., Beaverton, Oreg.

[21] Appl. No.: 272,497

[22] Filed: Nov. 21, 1988

Related U.S. Application Data

[63] Continuation-in-part of Ser. No. 147,365, Jan. 26, 1988, abandoned.

[51] Int. Cl.[5] ..... A61F 3/00; A43B 7/20

[52] U.S. Cl. ..... 36/89; 36/90; 128/80 H

[58] Field of Search ..... 36/89, 90, 132; 128/80 H, 581, 166; 2/22 R

[56] References Cited

U.S. PATENT DOCUMENTS

| | | | |
|---|---|---|---|
| 112,952 | 3/1871 | Niswander | 36/89 |
| 130,639 | 8/1972 | Howe | 128/80 H |
| 459,616 | 9/1891 | Von Rohonczy | 36/89 |
| 713,912 | 11/1902 | Nathan | 128/80 H |
| 1,546,551 | 7/1925 | Petri | 36/89 |
| 1,549,382 | 8/1925 | Riddell | 36/113 |
| 2,847,991 | 8/1958 | Andrews | 128/80 H |
| 2,952,459 | 9/1960 | Moffitt | 128/80 H |
| 2,972,822 | 2/1961 | Tanner | 36/89 |
| 3,064,644 | 11/1962 | Patterson | 36/89 |
| 3,073,305 | 1/1963 | Biggs, Jr. et al. | 128/166 |
| 3,268,912 | 8/1966 | Whelan | 128/166 |
| 3,327,410 | 6/1967 | Park, Sr. et al. | 36/2.5 |
| 3,387,305 | 6/1968 | Shafer | 2/22 |
| 3,490,450 | 1/1970 | Gardner | 128/166 |
| 3,527,209 | 9/1970 | Baker | 128/80 H |
| 3,834,377 | 9/1974 | Lebold | 128/80 H |
| 4,102,337 | 7/1978 | Golia | 128/80 E |
| 4,103,897 | 8/1978 | Ostyn | 128/80 H |
| 4,133,311 | 1/1979 | Karczewski | 128/166 |
| 4,255,877 | 3/1981 | Bowerman | 36/129 |
| 4,451,996 | 6/1984 | Norton et al. | 36/129 |
| 4,523,394 | 6/1985 | Lindh et al. | 36/89 |
| 4,547,981 | 10/1985 | Thais et al. | 36/89 |
| 4,556,054 | 12/1985 | Paulseth | 128/80 H |
| 4,577,419 | 3/1986 | Chassaing | 36/89 |
| 4,646,726 | 3/1987 | Westin et al. | 128/80 H |
| 4,649,939 | 3/1987 | Curtis | 128/80 H |
| 4,676,011 | 6/1987 | O'Rourke et al. | 36/89 |
| 4,719,926 | 1/1988 | Nelson | 36/89 |
| 4,753,229 | 6/1988 | Sutherland | 36/89 |

FOREIGN PATENT DOCUMENTS

| | | | |
|---|---|---|---|
| 25437 | 8/1906 | Fed. Rep. of Germany | 36/89 |

OTHER PUBLICATIONS

"Air-Stirrup" Journal of Bone & Joint Surgery pp. 99, 10/1987, 128/80 H.

Converse Shoe Advertisement—Maverick Basketball Shoe.

*Primary Examiner*—Steven N. Meyers

*Attorney, Agent, or Firm*—Banner, Birch, McKie & Beckett

[57] ABSTRACT

An improved athletic shoe for resisting ankle inversion is disclosed. The shoe includes an inversion resisting device which prevents inversion of the ankle while permitting a full range of motion in the other planes or directions of motion, i.e., eversion, plantar flexion, and dorsi flexion. The inversion resisting device includes a leg engaging strap, a strapping mechanism, a fastening device and an inversion resistance adjusting mechanism. The leg engaging strap surrounds the leg at an adjustable position above the ankle joint. The leg engaging strap is connected to the shoe by the strapping mechanism which is disposed only on the lateral side of the shoe upper. The strapping mechanism is connected to the shoe by a fastening device which permits a full range of movement in all directions other than inversion in an area centered about the axis of motion of the ankle. The amount of inversion resistance is adjustable by the inversion resistance adjusting mechanism which adjustably sets the length of the strapping mechanism.

22 Claims, 4 Drawing Sheets

ATHLETIC SHOE WITH INVERSION RESISTING DEVICE

This application is a continuation-in-part of U.S. Ser. No. 147,365, filed Jan. 26, 1988, now abandoned.

TECHNICAL FIELD

The present invention relates to an improved athletic shoe. More particularly, the present invention relates to an athletic shoe which allows the ankle unrestricted range of motion in all planes or directions except inversion.

BACKGROUND OF THE INVENTION

The ankle joint is one of the most frequently sprained joints in the body. External rotation of the ankle or turning the foot outwardly is known as eversion or supination, and internal rotation of the ankle or inward turning of the foot is known as inversion or pronation.

Very few injuries to the muscles and tendons of the ankle occur from eversion; rather the majority of ankle sprains are caused by excessive inversion, damaging ligaments of the lateral complex. The three ligaments making up the lateral complex (lateral collateral ligaments) are: posterior talofibular, calcaneofibular and anterior talofibular. The most frequently damaged ligaments are the anterior talofibular (E) and the calcaneofibular (F), shown in FIG. 13. The occurrence of injuries to these two ligaments can be reduced by restricting inversion.

It is very important when restricting inversion that plantar and dorsi flexion are not hindered, as this leads to decreased performance during athletic activity. The axis of motion for foot plantar and dorsi flexion occurs just inferior to the lateral malleolus. This "pivot point" must be taken into consideration when any restrictive devices are applied to the ankle. Any pivot point on a restrictive device must be aligned with the axis of motion of the ankle.

Prior art devices and methods for minimizing the risk of sprained ankles include taping the ankle to immobilize it against excessive internal rotation, and support systems built into shoes. Taping the ankles of athletes is a time consuming and expensive procedure. It generally cannot be accomplished properly by the athlete himself, but rather requires a trainer with special knowledge of how to tape ankles properly in order to effectively protect the ankle.

Athletic shoes have attempted to deal with this problem. Traditional shoe support systems addressing ankle motion control have used either rigid members, elastic materials, or straps to provide ankle support. These systems have not addressed several key factors; i.e., the need for individual adjustment of the amount of inversion support, the desirability of restricting only inversion, and positioning the foot in a properly supinated position when landing to help prevent fallover.

Recent attempts to incorporate ankle support members and braces into shoes either insufficiently prevent inversion or impede plantar flexion, dorsi flexion, and eversion. U.S. Pat. No. 3,327,410 to Park, Sr., et. al., discloses a hightop athletic shoe having two strap members anchored to opposite sides of the sole on the inside of the shoe. These straps impede plantar flexion and tend to cut off circulation to the foot. U.S. Pat. Nos. 4,547,981 to Thais et. al., and 4,577,419 to Chassaing disclose hightop athletic shoes with one strap ankle protectors. Both of these shoes use only one strap wrapped around the outside of the shoe rather than directly around the leg to support the ankle. Because the straps are wrapped around the outside of the shoe rather than directly around the leg, they do not properly conform to the leg and therefore, cannot provide adequate support. Inadequate ankle support also occurs because the shoes use only a single strap, which must be relatively long, and the excess length of the single strap results in excessive play.

U.S. Pat. No. 4,556,054 to Paulseth discloses an ankle orthosis with an ankle cuff, a foot plate and a means of connection between the two. This device incorporates a strap connected to the rearward lateral portion and the forward lateral portion of the foot plate. A strapping mechanism such as this, with two widely spaced originating points on the lateral side, will restrict plantar and dorsi flexion. The pivot point of this device does not align with the axis of motion of the ankle. Also, unlike the ankle with its constant pivot point, this device's pivot point grossly alters position during plantar and dorsi flexion.

SUMMARY OF THE INVENTION

The athletic shoe according to the present invention includes an outsole, an upper attached to the outsole, and securing means for closing the upper around the foot. An inversion resisting device is provided for resisting inversion, while permitting eversion, plantar flexion and dorsi flexion. The inversion resisting device includes a leg engaging strap, a strapping mechanism, a fastening mechanism and an adjusting mechanism to adjust the degree of inversion resistance provided by the device. The strapping mechanism is disposed on the lateral side of the shoe upper and crosses at least partially the lateral malleolus and the ankle and subtalor joints of the foot. The strapping mechanism is fastened between the leg engaging strap and the upper. The leg engaging strap surrounds the leg at least at, and preferably just above, the maximum width of the malleoli (ankle bones), and the length of the strapping mechanism between the leg engaging strap and the upper is adjustable to adjust the amount of inversion resistance. The strapping mechanism is connected to the upper by the fastening mechanism which permits this adjustably and flexibly. The lowest point on the strapping mechanism which is free to flex (the pivot point) is located substantially directly over the ankle's axis of motion.

In one embodiment of the invention, an upper end of the strapping mechanism is connected to the leg engaging strap by a ratchet closure mechanism, and is pivotably and slidably connected to the shoe upper at its lower end. In another embodiment of the invention, the strapping mechanism comprises a flexible strap, and a connecting mechanism such as a clip and sliding bar, a buckle or a buckle and bent ring, connects the flexible strap to the shoe upper in such a manner that the effective length of the flexible strap can be adjusted. In another embodiment, a fastening buckle which adjustably connects the strapping mechanism to the upper, is attached directly to the upper at a location below and adjacent to the pivot point of the ankle.

The inversion resisting device for the athletic shoe of the present invention includes three primary components: a fastening mechanism to connect the device to the shoe, and two strap portions. The first strap portion is the leg engaging member which is directly and firmly wrapped around and connected to the leg of a wearer.

The second strap portion is the strapping mechanism and connects the first strap portion to the shoe through the fastening mechanism. The use of a double strap system alleviates many of the problems of prior art shoes. The first leg engaging strap is held at a fixed position at or above the maximum width of the malleoli by its direct contact with the leg, and the separate second strap has a fixed, but adjustable length. Direct contact of the leg engaging strap with the leg refers to the fact that the strap does not wrap around the outside of the shoe upper, but rather wraps directly around the leg or clothing worn on the leg, such as socks. Play between the shoe and the leg is thus eliminated, thereby providing the required support and stability for the ankle.

The leg engaging strap is held above the ankle joint (the joint between the tallus, tibia and fibula bones), i.e. above the area where injury occurs, and therefore, above the area where ankle motion occurs and must be selectively inhibited. The leg engaging strap is thus located in an area where the inversion resisting device can best prevent inversion while permitting eversion, plantar flexion, and dorsi flexion. Toward this end, the leg engaging strap is adjustably fastened to the strapping mechanism thereby permitting the strap to close around the leg at or just above the maximum width of the malleoli of any sized user. Moreover, because the leg engaging strap wraps around the leg directly, it conforms to the leg and provides more precise support. The inversion resisting device restricts inversion only, while eversion is unrestricted because the strapping mechanism is located only at the lateral side of the shoe. Also, since the pivot point of the strapping mechanism is aligned with the ankle's axis of motion, plantar flexion and dorsi flexion are also unrestricted.

Another important aspect of the present invention is the capability of adjusting the amount of inversion resistance provided to the shoe. This adjustability is accomplished by adjusting the length of the strapping mechanism between its connections to the upper and the leg engaging strap. Thus, the shorter the length of the strapping mechanism, the less inversion is permitted. Finally, the shoe can include a spring mechanism to position the foot in a proper supinated position during landing. This spring mechanism can be a piece of elastic material, such as gore, disposed within the strapping mechanism or the fastening mechanism to provide a restoring force to bring the foot to a supinated position. Alternatively, movement of the skin within the leg engaging strap which is secured directly to the leg can provide the restoring force.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF PREFERRED EMBODIMENTS

Figure 1:
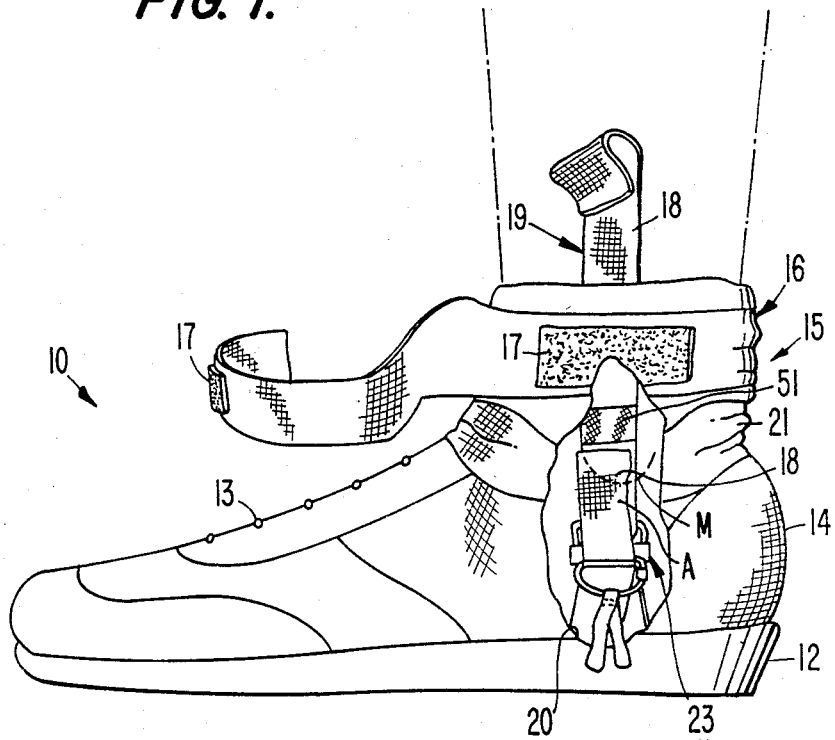
FIG. 1 is a lateral side view, partially cut-away, of an athletic shoe in accordance with a first embodiment of the invention.
Figure 2:
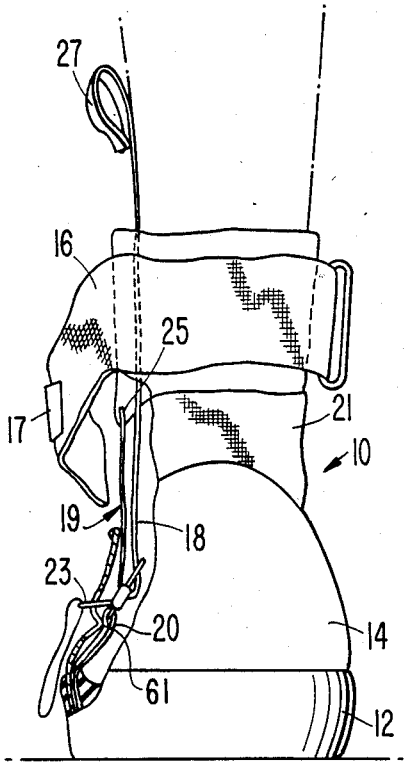
FIG. 2 is a rear view, partially cut-away, of the athletic shoe shown in FIG. 1.
Figure 4:
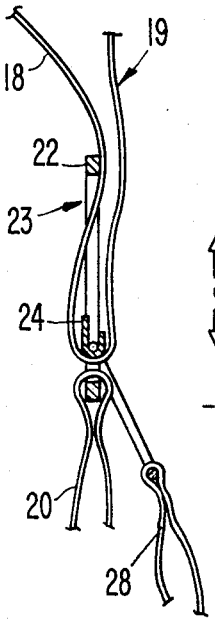
FIG. 4 is a sectional view taken generally along line 4—4 of FIG. 3.
Figure 11:
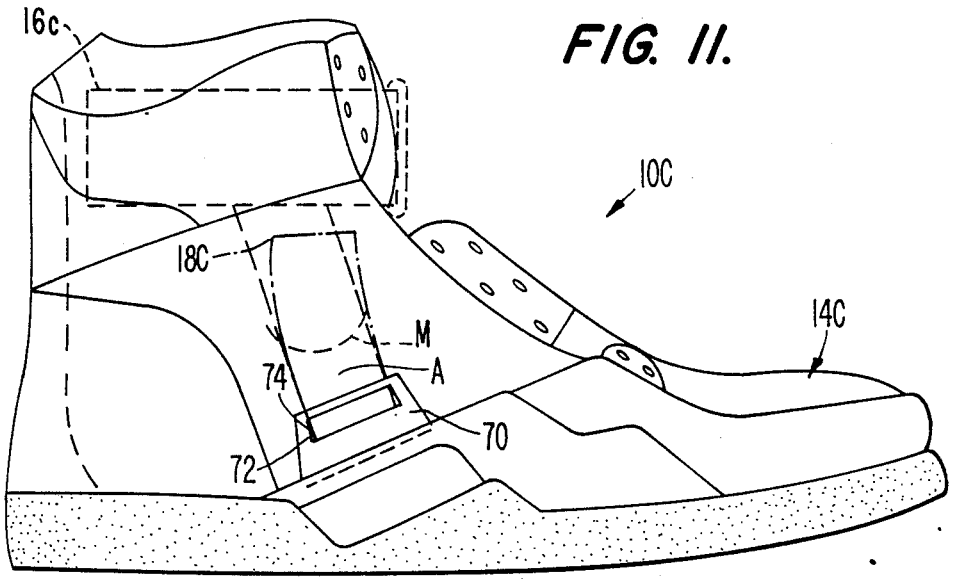
FIG. 11 is a lateral side view of another hightop athletic shoe embodiment according to the present invention.

FIGS. 1 through 4 illustrate one embodiment of an athletic shoe in accordance with the present invention. The position of various components of the present invention relative to the bones and certain ligaments of the foot is illustrated in FIG. 11. As best illustrated in FIG. 1, athletic shoe 10 comprises sole 12 permanently fastened to upper 14 in a conventional manner such as with an adhesive. Sole 12 can be of any conventional design such as a cupsole for use in a court shoe or a combination midsole/outsole typically used in running shoes. Athletic shoe 10 is fastened about the foot of a wearer by conventional securing means such as laces 13. An inversion resisting device 15, which includes a leg engaging cuff or strap 16, a strapping mechanism 19, a connecting or fastening strap 20, and an adjustment mechanism 23 is incorporated into athletic shoe 10.

Figure 6:
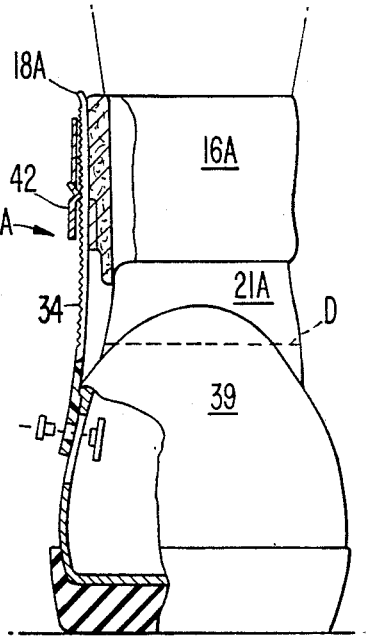
FIG. 6 is a rear view, partially cut-away, of the athletic shoe shown in FIG. 5.
Figure 7:
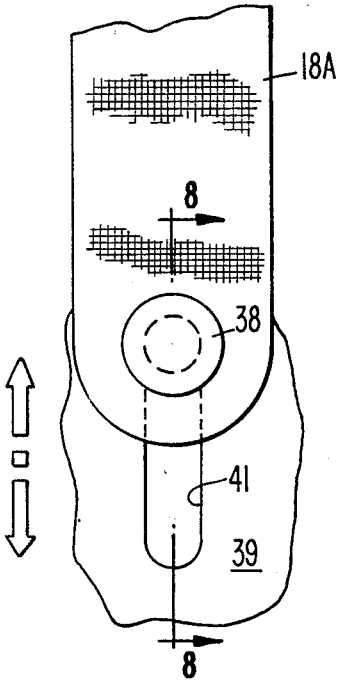
FIG. 7 is a side view, on an enlarged scale, of the lower portion of the strapping mechanism of FIG. 5.
Figure 13:
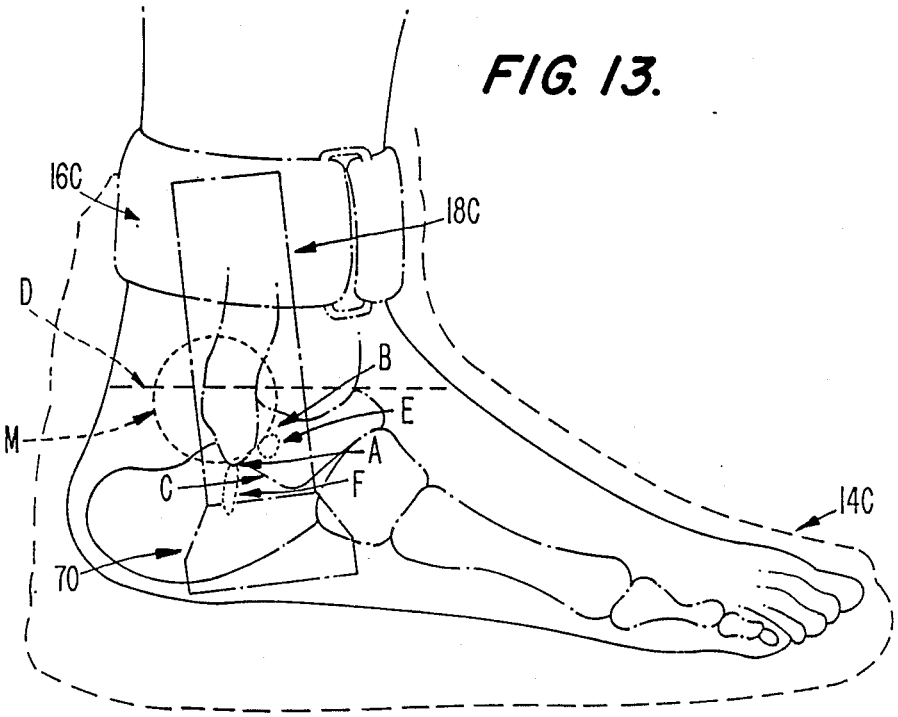
FIG. 13 is a lateral side view diagrammatically illustrating the position of the elements of inversion prevention device relative to the bones of the foot.

Leg strap 16 is formed as a wrap around strap independent of upper 4 and flexibly surrounds the leg at or just above the widest area of the medial and lateral malleolus, indicated as line D in FIGS. 6 and 13. The area of the lateral malleolus is indicated by the dashed line circle M in FIG. 13, and the lower portion of the lateral malleolus is indicated by the dashed curved line M in FIGS. 1, 5, 9, 11 and 12. Leg strap 16 is adjustable to accommodate legs of various circumferences and is made of a material which is sufficiently pliable to conform to the leg. In the alternative, leg strap 16 may be molded and contoured to fit the distal portion of the leg. Leg strap 16 is adjustably fastened about the leg using a conventional fastening device, preferably hook and loop fasteners 17. The proper and secure fit of leg strap 16 to the leg is important to providing maximum ankle support and maximum comfort.

Leg strap 16 serves as the attachment point for the strapping mechanism 19 to the leg at a point above the ankle joint. It is important to move the connection point above the ankle joint and to keep the connection point secured in position, since it is inversion motion about the ankle joint which must be inhibited in order to prevent injury. This is accomplished by securing leg strap 16 directly to the leg at, and preferably just above the widest area of the malleoli. It is also important to have leg strap 16 independent of upper 14 so that leg strap does not inhibit motion in directions other than inversion. Thus, leg strap 16 can be made totally separate from upper 14, or can be connected to upper 14 by a stretch material such as a four-way stretch material 21.

Strapping mechanism 19 includes an inversion resistance strap 18 formed of a flexible, substantially non-stretch material such as nylon webbing. Inversion resistance strap 18 attaches leg strap 16 to shoe upper 14. Strap 18 is disposed on the lateral side only of shoe 10. The flexibility of strap 18 about a particular area, combined with its disposition only on the lateral side of shoe 10, allows inversion resisting device 15 to support the ankle joint during inversion while permitting the normal range of motion in eversion, plantar flexion, and dorsi flexion. As shown diagrammatically in FIG. 13, strap 18 extends at least partially across the lateral malleolus M, the ankle joint B and the subtalor joint C (the joint between the calcaneus and the talus). This location is optimum for providing inversion control to the ankle, and also for providing protection for the anterior talofibular, the calcaneofibular ligament and the posterior talofibular ligament.

Inversion resistance strap 18 is connected to upper 14 by a fastening system such as fastening strap 20. Strap 18 preferably passes at least over a portion of the lateral malleolus M, as shown diagrammatically in FIG. 13. Fastening strap 20 together with an adjustment mechanism 23 anchors strap 18 to shoe 10. Fastening strap 20 is preferably attached to upper 10 in an area generally between upper 14 and outsole 12. See FIG. 2 wherein ends of strap 20 are embedded in sole 12.

Figure 3:
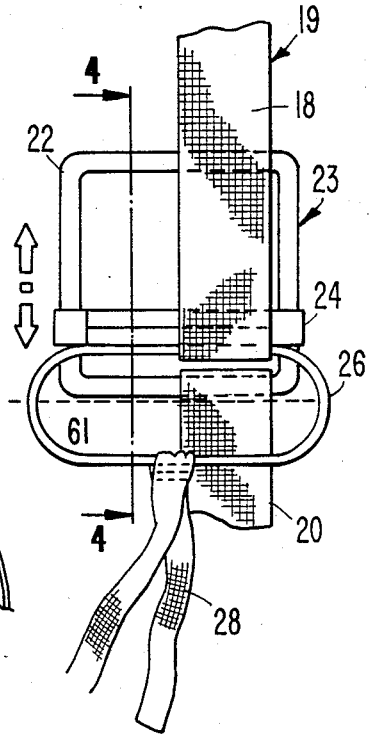
FIG. 3 is an illustration, on an enlarged scale, of the connection between the strapping and fastening mechanisms of the athletic shoe shown in FIG. 1.
Figure 5:
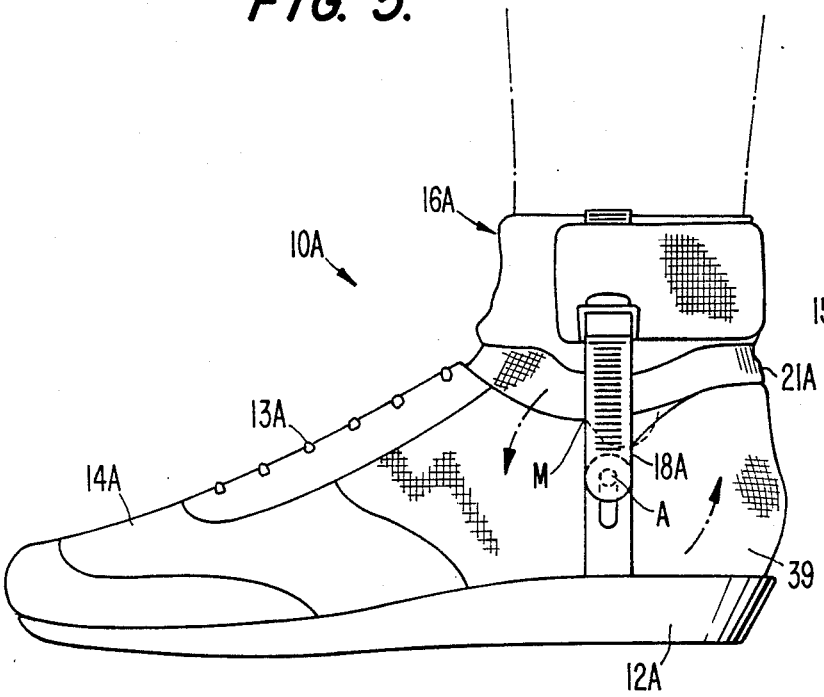
FIG. 5 is a lateral side view of an alternate embodiment of the athletic shoe according to the present invention.

Adjustment mechanism 23 is used to adjust the degree of inversion resistance provided by inversion resisting device 15 by varying the length of inversion resistance strap 18 between its connection points to leg strap 16 and fastening strap 20. As best shown in FIG. 3, adjustment mechanism 23 includes a clip 22, a sliding bar 24, a hoop 26 and a release strap 28. Clip 22 is permanently fastened to shoe 10 by connecting strap 20 looping through it. As shown by line 61 in FIGS. 2 and 3, strap 20 is stitched to upper 14 immediately adjacent clip 22 in order to hold clip 22 in position with respect to the upper. With clip 22 held in position against the upper, the flexibility of strapping mechanism 19 is limited to a location above the lower portion of clip 22 and to strap 18. Clip 22 is preferably a metal clip and sliding bar 24 is slidably carried on spaced parallel legs of clip 22. Hoop 26, preferably in the form of metal cable, is attached to bar 24. Strap 18 has a first end 25 sewn to leg cuff 16. Strap 18 extends downward from first end 25, loops around bar 24 and loop 26, and thereafter passes upward between an upper cross bar of clip 22 and the first portion of the strap. The second end 27 of strap 18 passes inside of and above leg strap 16.

When tension is applied to the strap, such as during inversion motion, bar 24 and clip 22 prevent strap 18 from slipping through clip 22 and thus set the length of strap 18 up to its connection point with leg strap 16. Thus, once strap 18 becomes taut during inversion motion, it resists any further inversion by the ankle. To change the length of strap 18 between bar 24 and first end 25, tension provided by bar 24 is released by pulling release strap 28 which is connected to loop 26, and strap 18 is moved to shorten or lengthen its effective length. The amount of inversion permitted by strap 18 is thereby adjusted. Release strap 28 passes through a hole in the side of upper 14. Alternatively, adjustment of the effective length of inversion strap 18 could be performed by a double D-ring, a cam, a hook and loop closure, or some other device which permits changing the functional strap length to the desired length.

With clip 22 secured to upper 14, the flexibility of strapping mechanism 19 is restricted to strap 18 and begins in the area slightly above clip 22 of adjustment mechanism 23. Clip 22 is positioned with respect to the upper so that beginning of this flexible area is generally centered over the ankle's axis of motion, indicated as A in FIGS. 1, 5, 9, 11, 12 and 13. Thus, the lowest point of strapping mechanism 19, which is free to flex and therefore to pivot in plantar and dorsi flexion and eversion, is located substantially directly over the ankle's axis of rotation A. In the embodiment of FIGS. 1–4, since strap 18 is a flexible strap, the flexing and pivot motion occurs about an area surrounding axis A, rather than at a single point aligned with axis A. If this flexibility pivot area does not surround axis A, plantar and dorsi flexion would be inhibited. Similarly, if the flexibility/pivot area is allowed to change location along the length and/or height of the upper, plantar and dorsi flexion would again be inhibited. Therefore, in order to assure uninhibited plantar and dorsi flexion and eversion, it is important that the lowest flexibility/pivot area of the strapping mechanism be generally centered about the axis of motion of the ankle.

In the embodiment of FIGS. 1–4, inversion resistance strap 18, along with fastening strap 20, clip 22, sliding bar 24, and hoop 26, are disposed inside shoe 10. Only release strap 28 and the second end 27 of strap 18 extend outside of shoe 10. However for comfort purposes, an inner layer of material which forms the foot contacting surfaces of upper 14 is disposed between inversion strap 18 and the foot.

A portion of either strap 18 can be formed of an elastic material such as a gore 51. The use of a small section of elastic material has the advantage of causing the inversion resistance provided by device 15 to occur less abruptly than would occur if straps 18 and 20 were made entirely of non-stretch material. Nevertheless, strap 18 remains substantially non-stretchable in order to perform its inversion resistance function. An additional advantage to the use of such an elastic section occurs because the elastic section provides a restoring force to the lateral side of the foot, which moves the foot to a proper supinated position after the foot leaves the ground and before the next foot plant.

An alternate embodiment of an athletic shoe 10A in accordance with the present invention is shown in FIGS. 5–8. Elements of shoe 10A, which correspond to similar elements of shoe 10, will be indicated by like numbers with the suffix A. In shoe 10A, flexible strap 18 is replaced by a substantially rigid, but vertically slidable and pivotable, strap 18A; and adjustment of the amount of inversion resistance is made using a ratchet system.

Figure 8:
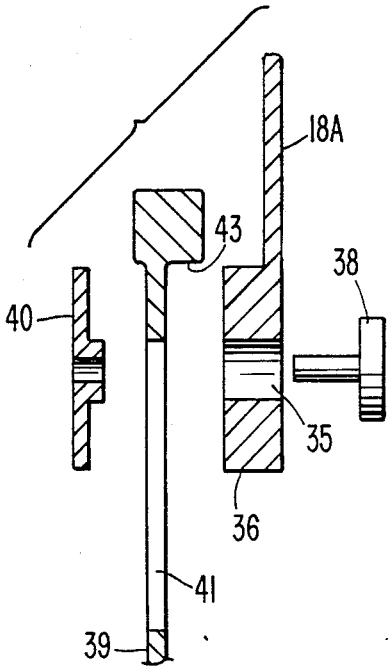
FIG. 8 is an exploded sectional view taken generally along line 8—8 of FIG. 7.

Inversion strap 18A comprises a substantially rigid molded plastic member. Beveled grooves 34 are formed on one of the surfaces along the upper end of strap 18A and an aperture 35 is formed through a boss 36 located at the lower end of strap 18A. Shoe 10A has a substantially rigid plastic heel counter 39 with an elongate vertical slot 41 formed along its lateral side. Inversion strap 18A is pivotably and vertically slidably fastened to slot 41 in heel counter 39 by a screw 38 and a washer 40, although any other conventional fastening method may be used. The slidable coupling of strap 18A to slot 41 of heel counter 39 permits eversion, and the pivotable connection between inversion strap 18A and upper 14A allows for unrestricted dorsi and plantar flexion. As best seen in FIGS. 6 and 8 heel counter 39 has an enlarged abutment ridge 43 above and in alignment with slot 41. Inversion is prevented or restricted by the contact of boss 36 against abutment 43. Abutment ridge 43 and slot 39 are located so that, when inversion is prevented by the contact of boss 36 against abutment 43, strap 18 A pivots about the general area of the axis of motion of the ankle A. Thus, the lowest point of the strapping mechanism, which is free to pivot while also resisting inversion, is located substantially directly over the ankle's axis of rotation A.

A female end 42 of a conventional ratchet closure is attached to leg strap 16A to adjustably connect the upper end of strap 18A to leg strap 16A. Beveled grooves 34 of inversion strap 18A are received in female end 42 of the ratchet closure. The effective length of strap 18A between boss 36 and the connection at female end 42 of the ratchet closure is adjusted by moving and fixing the upper end of strap 18A in female end 42. Adjustment of the effective length of strap 18A adjusts the degree of inversion resistance provided by inversion resistance device 15A.

Figure 9:
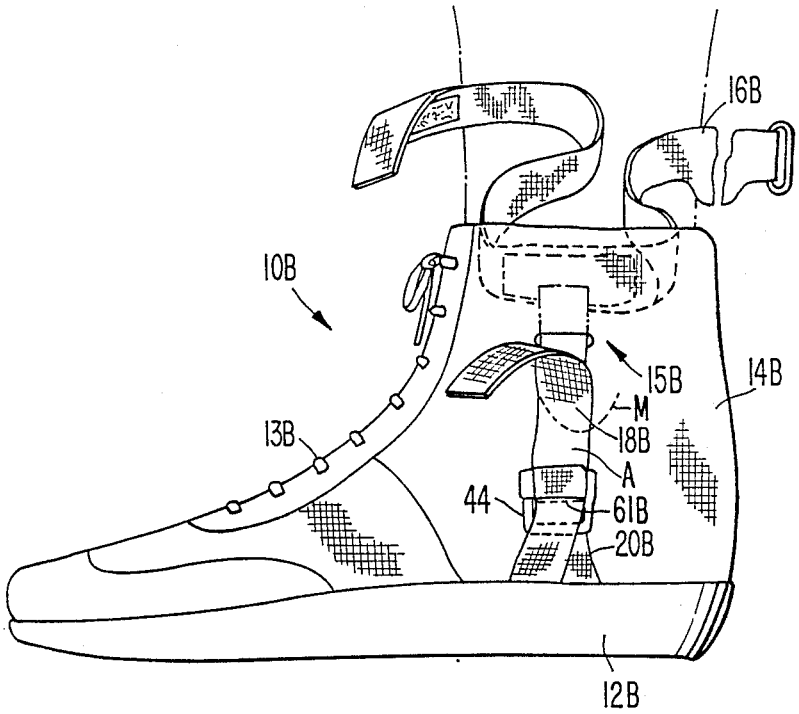
FIG. 9 is a lateral side view of a hightop athletic shoe embodiment according to the present invention.
Figure 10:
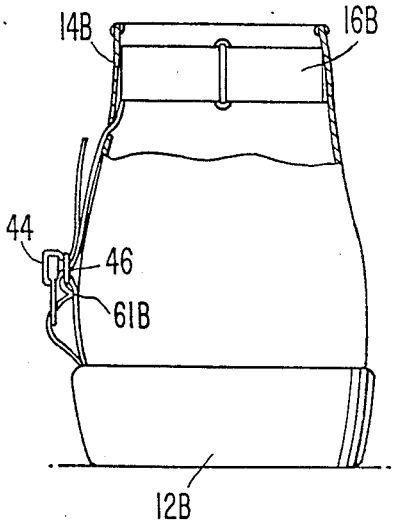
FIG. 10 is a rear view, partially cut-away, of the athletic shoe shown in FIG. 9.

FIGS. 9 and 10 illustrate another embodiment of athletic shoe 10B with an inversion resisting device 15B, wherein the shoe is a hightop shoe that encases the ankle. Elements of shoe 10B, which correspond to similar elements of shoe 10, will be indicated by the like numbers with the suffix B. Inversion resistance device 15B uses a conventional buckle 44 and bent ring 46 in place of clip 22, sliding bar 24, hoop 26, and release strap 28 used in device 15. Also, leg strap 16B is incorporated inside, but still preferably separate from, upper 14B. The length of inversion strap 18B, and therefore the degree of inversion resistance provided by device 15B, is adjusted by pulling it through buckle 44 and bent ring 46. The adjustable strapping mechanism except for the end of inversion strap 18B where it fastens to leg strap 16B, is disposed outside of shoe 10B. Buckle 44 is stitched to upper 14B along stitch line 16B. Also, buckle 44 is in position with respect to upper 14B so that the beginning of the flexible area of strap 18B is generally centered over the ankle's axis of motion A. As with the other strapping mechanisms which utilize a flexible strap, the lowest point of the strapping mechanism, which is free to flex and therefore to pivot in plantar and dorsi flexion and eversion, is located substantially directly over the ankle's axis of rotation. This flexing and pivot motion occurs about an area surrounding axis A rather than at a single point aligned with axis A.

Figure 12:
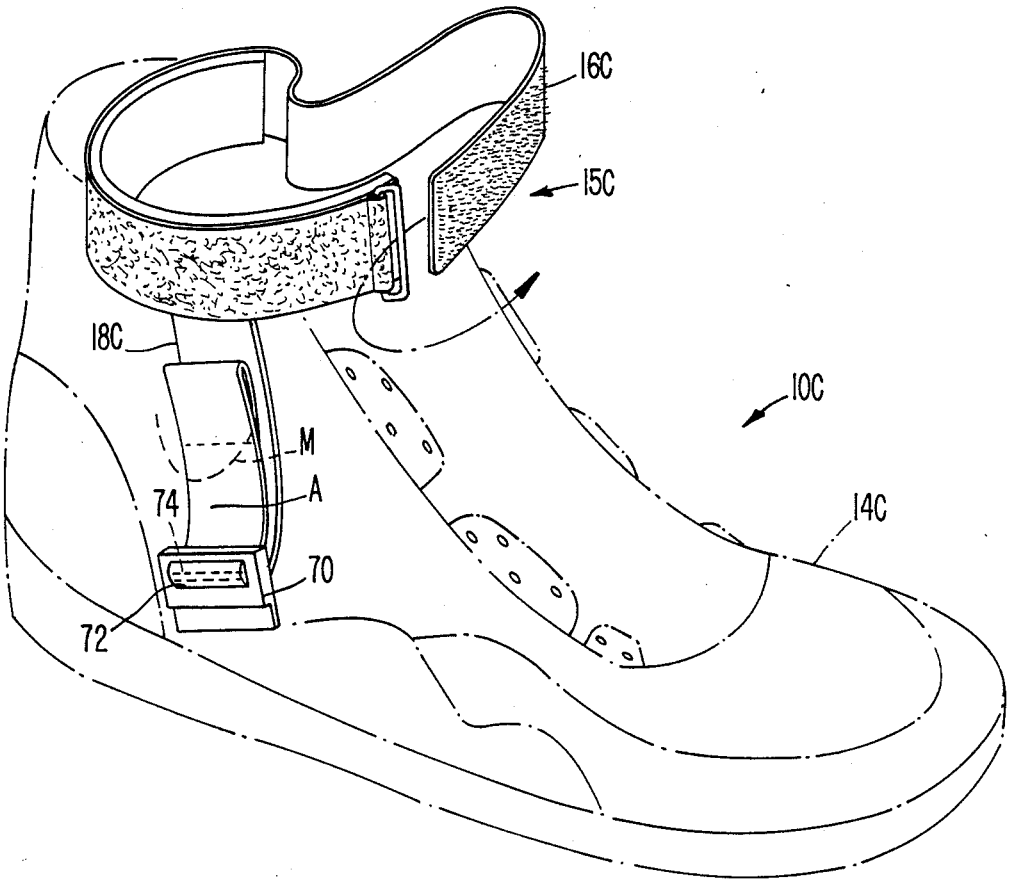
FIG. 12 is a perspective view of the shoe illustrated in FIG. 11, with the shoe upper and sole shown in phantom line and the inversion resisting device in full line.

FIGS. 11 and 12 illustrate another embodiment of a hightop athletic shoe 10C with an inversion resisting device 15C. Elements of shoe 10C, which correspond to similar elements of shoe 10, will be indicated by like numbers with the suffix B. Inversion resistance device 15C uses a conventional single piece buckle 70 which is secured directly to the exterior of upper 14C. Leg strap 16C and inversion strap 18C are located inside, but still separate from, upper 14C. Buckle 70 has an elongate opening 72 with a gripping bar 74 extending centrally along the length of opening 72. The lower free end of inversion strap 18C is passed through an opening in upper 14C, which is aligned with opening 72 of buckle 70, and thereafter passed through opening 72 and around gripping bar 74. The operative length of inversion strap 18C is adjusted by simply loosening strap 18C about gripping bar 74 and therafter positioning strap 18C to the desired length. Once the location of strap 18C about gripping bar 74 is adjsuted pulling on the upper end of inversion strap 18C frictionally engages the strap to the gripping bar and prevents any additional movement.

As with the other strapping mechanisms which utilize a flexible strap, buckle 70 is positioned with respect to upper 14C so that the beginning of the flexible area of strap 18C is generally centered over the ankle's axis of motion A. Thus, the lowest point of the strapping mechanism, which is free to flex and therefore to pivot in plantar and dorsi flexion and eversion, is located substantially directly over the ankle's axis of rotation A. This flexing and pivot motion occurs about an area surrounding axis A, rather than a single point aligned with axis A.

In all embodiments, the inversion strap is located on the lateral side only of the shoe and, at least partially, crosses the lateral malleolus and the ankle and subtalor joints of the foot, and the leg strap surrounds the leg just above the ankle joint. Also, the lowest area of the strapping mechanism, which is free to flex and pivot in planter and dorsi flexion and eversion, is located in an area generally centered about the pivot point of the ankle. Locating the strap in this manner optimally prevents inversion while permitting eversion, dorsi flexion, and plantar flexion.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

I claim:

1. An athletic shoe for resisting ankle inversion comprising:

a sole;

an upper attached to said sole;

securing means for closing said upper around the foot;

an inversion resisting device for resisting ankle inversion including a leg engaging strap, a strapping mechanism, fastening means; and adjusting means for adjusting the degree of inversion resistance;

said leg engaging strap being adjustably positionable around the leg and above the ankle joint;

said strapping mechanism being disposed only on the lateral side of said upper and crossing at least partially the lateral malleolus and the ankle and subtalor joints, said strapping mechanism being movable to permit an unrestricted range of motion in all directions other than inversion; and said fastening means fastening a portion of said strapping mechanism to said upper at a location below and adjacent to the axis of motion of the ankle to permit said movability of said strapping mechanism in an area centered about the axis of motion of the ankle.

2. An athletic shoe as set forth in claim 1 wherein said adjusting means includes a means for varying the length of said strapping mechanism between said fastening means and said leg engaging strap.

3. An athletic shoe as set forth in claim 1 or 2 wherein said inversion resisting device includes spring means for providing a restoring force to the foot to position the foot in a supinated position for foot landing.

4. An athletic shoe as set forth in claim 3 wherein said spring means includes disposing said leg engaging strap in substantially direct engagement with the leg so that movement of the skin during inversion resistance provides the restoring force to the inversion resisting device.

5. An athletic shoe as set forth in claim 3 wherein said spring means comprises at least one of said strapping mechanism and said fastening means including at least a portion formed of elastic material.

6. An athletic shoe as set forth in claim 1 wherein at least a portion of said strapping mechanism extends downwardly from said leg engaging strap and interior of an outermost layer of said upper.

7. An athletic shoe as set forth in claim 1, 2 or 6 wherein said leg engaging strap is disposed interior of the innermost layer of said upper.

8. An athletic shoe as set forth in claim 1, 2, or 6 wherein said adjustable strapping mechanism comprises a flexible strap formed of a flexible, substantially non-stretch material.

9. An athletic shoe as set forth in claim 8 wherein said fastening means comprises a fastening strap formed of a flexible, substantially non-stretch material, said fastening strap being attached to said shoe adjacent the area where said upper and said sole meet, and said adjusting means including a connecting mechanism for connecting said fastening strap to said flexible strap such that the length of said flexible strap can be adjustably set, said fastening strap attaching said connecting mechanism to said upper at a location below and adjacent to the axis of motion of the ankle.

10. An athletic shoe as set forth in claim 9 wherein said connecting mechanism includes a release mechanism for releasing the connecting mechanism from an adjustable set.

11. An athletic shoe as set forth in claim 8 wherein said fastening means and said adjusting means are formed of a single buckle attached to the exterior of said upper at a location below and adjacent to the axis of motion of the ankle.

12. An athletic shoe as set forth in claim 11 wherein said buckle is formed of a single piece of material with an elongate opening divided by a gripper bar, and a free end of said flexible strap being passed through said elongate opening and looped over said gripping bar.

13. An athletic shoe as set forth in claim 1 wherein said leg engaging strap is flexibly connected to said upper by a four-way stretch material so that said leg engaging strap is adjustably positionable with respect to said upper and permits an unrestricted range of motion in all directions.

14. An athletic shoe as set forth in claim 1, 2 or 13 wherein said adjustable strapping mechanism comprises a substantially rigid strap with a lower end pivotably and slidably fastened to said upper and an upper end coupled to said leg engaging strap by said adjusting means.

15. An athletic shoe as set forth in claim 14 wherein said adjusting means comprises ratchet coupling mechanism coupling said upper end of said substantially rigid strap to said leg engaging strap.

16. An athletic shoe as set forth in claim 14 wherein said upper end of said substantially rigid strap includes a plurality of vertically spaced grooves, said lower end includes a stop mechanism, and said leg engaging strap including a female end of a ratchet closure, said grooves matingly fastening to said female end.

17. An athletic shoe as set forth in claim 16 wherein said upper includes a substantially rigid counter, and said fastening means comprises a generally vertical slot extending through said substantially rigid counter and a connecting pin extending through said slot and connecting to said lower end of said substantially rigid strap so that said substantially rigid strap can move vertically to the extent of the length of said vertical slot.

18. An athletic shoe for resisting ankle inversion comprising:

a sole;

an upper attached to said sole and including a substantially rigid heel counter;

securing means for closing said upper around the foot;

an inversion resisting device for resisting ankle inversion including a leg engaging strap, a strapping mechanism, fastening means and adjusting means for adjusting the degree of inversion resistance;

said leg engaging strap being adjustably positionable above the ankle joint and including means for releasably securing it around the leg;

said strapping mechanism being disposed on the lateral side of said upper and crossing at least partially the lateral malleolus and the ankle and subtalor joints, said strapping mechanism being formed of a substantially rigid elongate strap having upper and lower ends;

said adjusting means including a female end of a ratchet mechanism attached to the lateral side of said leg engaging strap and a plurality of vertically spaced grooves formed along said upper end of said elongate strap for adjustably coupling to said female end of said ratchet mechanism so that the effective length of said elongate strap can be varied to adjust the degree of inversion resistance; and said fastening means for fastening said lower end of said strapping mechanism to said upper comprising a connecting pin extending to an opening in the lower end of said elongate strap and into an elongate opening in said heel counter whereby said strapping mechanism is free to pivot and slide vertically a limited degree to permit an unrestricted range of motion in all directions other than inversion.

19. An athletic shoe for resisting ankle inversion comprising:

a sole;

an upper attached to said sole;

securing means for closing said upper around the foot;

an inversion resisting device for resisting ankle inversion including a leg engaging strap, a strapping mechanism, fastening means and adjusting means for adjusting the degree of inversion resistance;

said leg engaging strap being adjustably positionable above the ankle joint and having means for releasably securing it around the leg;

said strapping mechanism being disposed only on the lateral side of said upper and crossing at least partially the lateral malleolus and the ankle and subtalor joints, said strapping mechanism comprising a flexible strap formed of a flexible, substantially non-stretch material, said flexible strap being attached at an upper end to said leg engaging strap, said strapping mechanism being movable to permit an unrestricted range of motion in all directions other than inversion;

said fastening means adjustably and flexibly fastening a lower end of said flexible strap to said upper at a location below and adjacent to the axis of motion of the ankle to permit said movability of the strapping mechanism in an area centered about the axis of motion of the ankle, said fastening means comprising a fastening strap formed of a flexible, substantially non-stretch material, said fastening strap being attached to said shoe adjacent the area where said upper and said sole meet; and said adjusting means including a connecting mechanism for connecting said fastening strap to said flexible strap such that the length of said flexible strap can be adjustably set to vary the resistance to inversion provided by said inversion resisting device.

20. An athletic shoe for resisting ankle inversion comprising:

a sole;

an upper attached to said sole;

securing means for closing said upper around the foot;

an inversion resisting device for resisting ankle inversion including a leg engaging strap, a strapping mechanism, fastening means and adjusting means for adjusting the degree of inversion resistance;

said leg engaging strap being adjustably positionable above the ankle joint and having means for releasably securing it around the leg;

said strapping mechanism being disposed only on the lateral side of said upper and crossing at least partially the lateral malleolis and the ankle and subtalor joints, said strapping mechanism comprising a flexible strap formed of a flexible, substantially non-stretch material, said flexible strap being attached at an upper end to said leg engaging strap, said strapping mechanism being movable to permit an unrestricted range of motion in all directions other than inversion;

said fastening means and said adjusting means adjustably and flexibly fastening a lower end of said flexible strap to said upper, said fastening means and said adjusting means comprising a single buckle attached to said upper at a location below and adjacent to the axis of motion of the ankle to permit said movability of said strapping mechanism in an area generally centered about the axis of motion of the ankle, a lower end of said flexible strap passing through and being adjustably fastened by said buckle.

21. An athletic shoe as set forth in claim 20 wherein said buckle is attached to the exterior of said upper.

22. An athletic shoe as set forth in claim 20 or 21 wherein said flexible strap extends downward from said leg engaging strap inside said upper.

* * * * *

UNITED STATES PATENT AND TRADEMARK OFFICE

CERTIFICATE OF CORRECTION

PATENT NO. : 4,922,630

DATED : May 8, 1990

INVENTOR(S) : John R. Robinson

It is certified that error appears in the above-identified patent and that said Letters Patent is hereby corrected as shown below:

In Column 8, line 4, "adjsuted" should be —adjusted--.

Signed and Sealed this

Thirtieth Day of July, 1991

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,922,630

DATED : May 8, 1990

INVENTOR(S) : John R. Robinson

It is certified that error appears in the above-identified patent and that said Letters Patent is hereby corrected as shown below:

Column 7, line 58, please delete "B" and insert --C--.

Signed and Sealed this

Thirty-first Day of March, 1992

*Attest:*

*Attesting Officer*

HARRY F. MANBECK, JR.

*Commissioner of Patents and Trademarks*